US005930559A

United States Patent [19]

De Kesel

[11] Patent Number: 5,930,559

[45] Date of Patent: Jul. 27, 1999

[54] MEANS FOR THE SEALING OF A TONER CARTRIDGE

[76] Inventor: Jan De Kesel, J.B. Lombaertdreef, 21, B-9810 Drongen, Belgium

[21] Appl. No.: 09/142,105

[22] PCT Filed: Feb. 27, 1997

[86] PCT No.: PCT/BE97/00022

§ 371 Date: Sep. 1, 1998

§ 102(e) Date: Sep. 1, 1998

[87] PCT Pub. No.: WO97/32242

PCT Pub. Date: Sep. 4, 1997

[30] Foreign Application Priority Data

Mar. 1, 1996 [BE] Belgium ..... 9600185

[51] Int. Cl.[6] ..... G03G 15/08

[52] U.S. Cl. ..... 399/106; 399/103

[58] Field of Search ..... 399/98, 102, 103, 399/105, 106, 109

[56] References Cited

U.S. PATENT DOCUMENTS

| | | | |
|---|---|---|---|
| 4,931,838 | 6/1990 | Ban et al. | 399/106 |
| 5,177,540 | 1/1993 | Honda et al. | 399/106 |
| 5,258,814 | 11/1993 | Davies | 399/105 |
| 5,282,003 | 1/1994 | Michlin | 399/103 |
| 5,523,828 | 6/1996 | DeKesel | 399/103 |
| 5,585,895 | 12/1996 | Yashiro et al. | 399/103 |
| 5,621,508 | 4/1997 | McNamara | 399/106 |

FOREIGN PATENT DOCUMENTS

| | | |
|---|---|---|
| 0 563 016 | 9/1993 | European Pat. Off. . |
| 0 651 297 A1 | 5/1995 | European Pat. Off. . |
| 93 13 184 | 2/1994 | Germany . |
| 295 08 194 U1 | 9/1995 | Germany . |

*Primary Examiner*—Sandra Brase
*Attorney, Agent, or Firm*—Sughrue, Mion, Zinn, Macpeak & Seas, PLLC

[57] ABSTRACT

A member for sealing a toner container for laser printer, copy machine and laser printer, comprising:

a) a film with a central strip intended to be torn off b) a pulling member bound to the central strip; and c) a foam layer with a central passage, said layer having a first part covered by the film and a second part not covered by the film, in which the lateral strips of the film are glued on the foam layer, while the central strip of the film is not glued on the said foam layer.

23 Claims, 3 Drawing Sheets

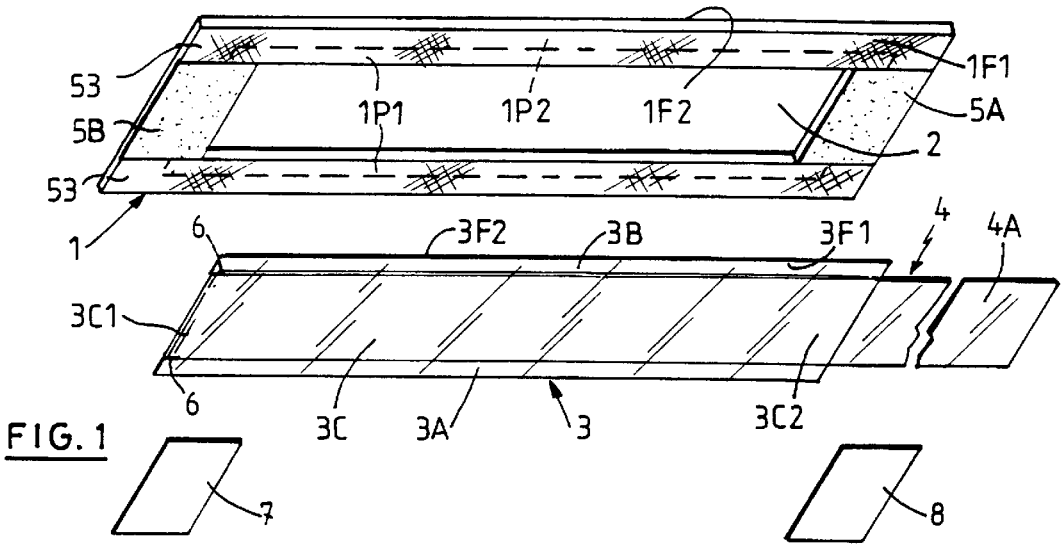
FIG. 1
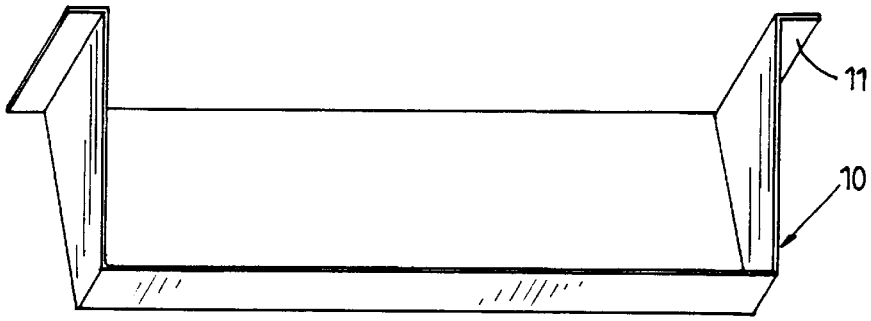
FIG. 2
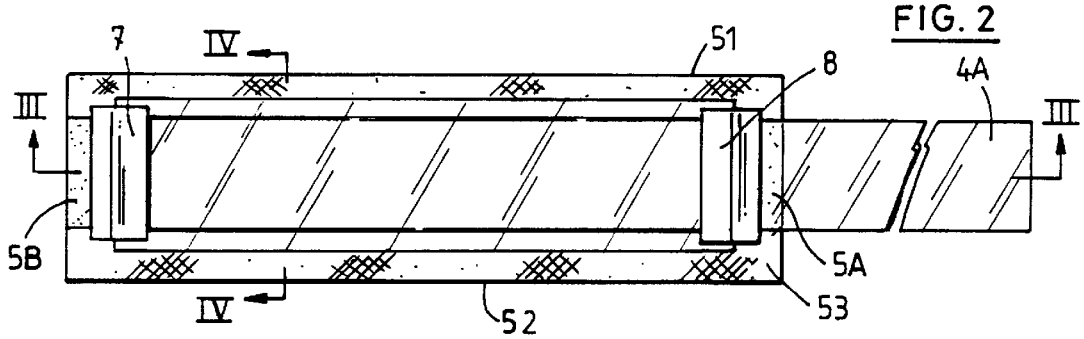
FIG. 3
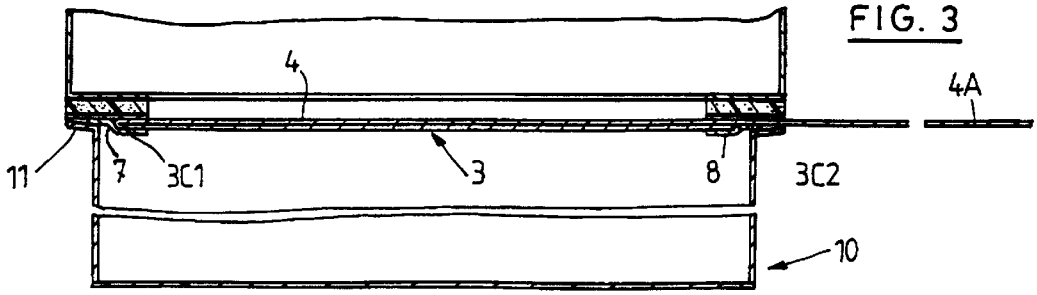

MEANS FOR THE SEALING OF A TONER CARTRIDGE

THE STATE OF THE ART

A cartridge with sealing means is described in EP 0 429 152. The means of this cartridge comprises:

a) a foam layer with a central opening, b) a film which partially covers the foam layer and which is glued on said foam layer, in which the film has a lower surface, which contacts the foam layer for closing the opening, and an upper surface, opposite to said lower surface.

A sealing means including two strips of foam situated left and right of the opening, whether or not afterwards provided with strips in front and back of the small side. This known means comprises a film that completely covers the surface of the strips.

Sealing means for cartridges consisting of a foam layer and a film and from which a small band can be torn off to form an opening are also known. In said known means, the foam layer is completely covered by the film.

The problems found with the existing sealing means are: a too high pull force required to form the opening and/or a process for the recycling of the cartridge which requires a cleaning of the surface of the cartridge, on which the sealing means has to be located.

To solve the problem concerning the pull force, it has been proposed that the small band to be torn off should not be glued onto the foam layer. With this embodiment, there is a danger for ink leaks or leakage.

BRIEF DESCRIPTION OF THE INVENTION

The present invention relates to a sealing means for forming a seal of an toner cartridge or a toner container, the said cartridge or container having a surface provided with an opening for the passage of toner, preferably a means, whereby the recycling of said cartridges or containers from printers, laser printers, copy machines, etc. is easy. The sealing means includes a film with a small band to be torn off, the pull force to tear off the band of which is not exaggerated, by means of which the recycling of a cartridge or container is possible, with or without cleaning of the surface on which the new seal has to be located (with or without removing the foam parts still sticking on the surface), and by means of which the ink leaks can be avoided or limited. According to the invention, a part of the foam layer which is not covered by the film contacts the toner cartridge, a part of this foam layer covering, with little or no influence on the film, the unevenness of the surfaces of the toner cartridge. This is advantageous for avoiding the leakage problems.

The means according to the invention comprises:

a) a film comprising two lateral strips and a central strip extending between a first end and a second end, said central strip being intended to be torn off from said first end to said second end so as to define an opening between the said lateral strips, said film having two opposite faces, one of which being intended to be directed towards the surface of the container provided with the opening;

b) a pulling means bound to the said first end of the central strip of the film; and c) a foam layer with a central passage, said layer having a first face intended to be directed towards the surface of the container provided with the opening, and a second face opposite to the said first face, the said first face having a first part covered by the film and a second part not covered by the film.

The lateral strips of the film are glued on the said first part of the first face of the foam layer, while the central strip intended to be torn off from the film is not glued on the said foam layer. The pulling means extends along the face of the film opposite to the face intended to be directed towards the surface of the container provided with the opening, the said pulling means being not glued on the foam layer, and, in the neighbourhood of the first end of the central strip, a means binds the foam layer with the lateral strips and with the central strip of the film so as to prevent toner leakage between the film and the foam at said first end of the central strip.

According to another embodiment, a means binds the foam layer with the lateral strips and with the first end of the central strip of the film so as to prevent toner leakage between the film and the foam at said first end of the central strip.

According to another embodiment, a means binds the foam layer with the face of the film intended to be directed towards the surface of the container provided with the opening so as to prevent toner leakage between the film and the foam at said first end of the central strip.

In another embodiment, the means for avoiding leaks is a small adhesive band which covers, on one hand, partially the foam layer, and on the other hand, partly the face of the film intended to be directed towards the surface of the container provided with the opening, as well as the first end of the central strip.

According to another embodiment, the first face of the foam layer has a part contacting the pulling means, said part being provided with a layer with a low friction coefficient.

According to another embodiment, the first face of the foam layer has a first part contacting the pulling means in the neighbourhood of the first end of the central strip of the film and a second part contacting the pulling means in the neighbourhood of the second end of the central strip of the film, said first and second parts of the foam layer being provided with a layer with a low friction coefficient.

According to a preferred embodiment, the first face of the foam layer has a first part contacting the pulling means in the neighbourhood of the first end of the central strip of the film, said first part of the foam layer being provided with a layer with a low friction coefficient, and, before moving the pulling means and tearing off the central part of the film, the means to avoid ink leaks is a band covering, on the one hand, partly the face of the film intended to be directed towards the surface of the container provided with the opening, as well as the first end of the central part of the strip, and, on the other hand, partly the first face of the foam layer, as well as partly the first part of the foam layer provided with a low friction layer.

According to a specific embodiment, the first face of the foam layer has a first part contacting the pulling means in the neighbourhood of the first end of the central strip of the film and a second part contacting the pulling means in the neighbourhood of the second end of the central strip of the film, said first and second parts of the foam layer being provided with a layer with a low friction coefficient. Before moving the pulling means and tearing off the central part of the film, a first band covers, on the one hand, partly the face of the film intended to be directed towards the surface of the container provided with the opening, as well as the first end of the central part of the strip, and, on the other hand, partly the first face of the foam layer, as well as partly the first part of the foam layer provided with a low friction layer. A second band covers, on the one hand, partly the face of the film intended to be directed towards the surface of the container provided with the opening, as well as the second end of the central part of the strip, and, on the other hand, partly the first face of the foam layer, as well as the second part of the foam layer provided with a low friction layer.

In another embodiment, the means for avoiding leaks between the central strip and the foam layer is a groove in the foam, in which the first end of the central strip or a part of the central strip adjacent to its first end is inserted.

According to another embodiment, the foam layer has a groove, in which a part of the pulling means adjacent to the second end of the central strip, as well as a part of the film adjacent to said second end of the central strip are inserted.

According to another embodiment, the foam layer consists of two distinct foam strips between which the central passage is defined.

The invention relates also to a toner container or a toner cartridge provided with a sealing means as disclosed hereabove.

BRIEF DESCRIPTION OF THE DRAWINGS

FIG. 1 is a perspective (exploded) view of the parts of a means according to the invention;

FIG. 2 is an upper view of the means of FIG. 1;

FIG. 3 and 4 are cross section views along the lines III—III and IV—IV of the means of FIG. 2;

DESCRIPTION OF EMBODIMENTS

Figure 4:
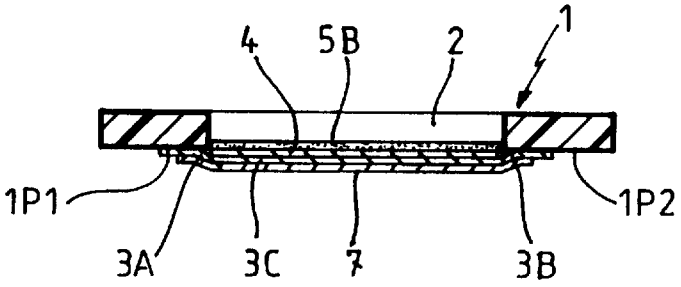

The means in FIG. 1 to FIG. 4, comprises:

a foam layer 1 (with closed cells, for example a polyurethane foam) with a central opening 2, a film 3 which partially covers the foam layer 1 and which is glued along its longitudinal edge parts 3A, 3B to the foam layer 1, and a pulling means 4 which is bound to the film 3.

The film 3 comprises two lateral or edge strips 3A, 3B and a central strip 3C extending between a first end 3C1 and a second end 3C2, said central strip 3C being intended to be tom off from said first end 3C1 to said second end 3C2 so as to define an opening between the said lateral strips 3A, 3B, said film having two opposite faces 3F1, 3F2, said face 3F1 being intended to be directed towards the surface 11 of the container 10 provided with the opening.

The pulling means 4 is bound to the said first end 3C1 of the central strip 3C of the film3.

The foam layer 1 with a central passage 2 has a first face 1F1 intended to be directed towards the surface 11 of the container 10 provided with the opening, and a second face 1F2 opposite to the said first face 1F1, the said first face 1F1 having a first part 1P1 covered by the film 3 and a second part 1P2 not covered by the film 3. Said second part 1P2 is advantageously provided with a glue layer so as to attach the said second part onto the surface 11 of the container 10. (See FIG. 4)

The lateral strips 3A, 3B of the film 3 are glued on the said first part 1P1 of the first face 1F1 of the foam layer 1, while the central strip 3C intended to be torn off from the film 3 is not glued on the said foam layer 1.

The central strip 3C has its end 3C1, which is located partially between two cuts 6 (means for reducing the initial pull force).

The pulling means 4 extends along the face 3F2 of the film 3 opposite to the face 3F1 intended to be directed towards the surface 11 of the container 10 provided with the opening. The said pulling means 4 is not glued on the foam layer 1.

The pulling means 4 is partially located in the opening or central passage 2 of the foam layer 1.

A part 4A of the pulling means is located outside the film 3.

In the neighbourhood of the first end 3C1 of the central strip 3C, a means 7 binds the foam layer 1 with the lateral strips 3A, 3B and with the central strip 3C of the film 3 so as to prevent toner leakage between the film 3 and the foam at said first end 3C1 of the central strip 3C.

In this embodiment, the means 7 binds the foam layer 1 with the lateral strips 3A, 3B and with the first end 3C1 of the central strip 3C of the film 3 so as to prevent toner leakage between the film 3 and the foam at said first end 3C1 of the central strip 3C.

More specifically, the means is a band or sticking strip 7 binding the foam layer 1 with the face 3F1 of the film 3 intended to be directed towards the surface 11 of the container 10 provided with the opening so as to prevent toner leakage between the film 3 and the foam at said first end 3C1 of the central strip 3C.

Said adhesive band or strip 7 covers, on the one hand, partially the foam layer 1, and, on the other hand, partly the face 3F1 of the film 3, as well as the first end 3C1 of the central strip 3C.

The first face 1F1 of the foam layer 1 has two parts contacting the pulling means 4, said parts 5A,5B being provided with a layer with a low friction coefficient (for example a silicone layer).

A first part 5B contacts the pulling means 4 in the neighbourhood of the first end 3C1 of the central strip 3C of the film 3, while the second part 5A contacts the pulling means 4 in the neighbourhood of the second end 3C2 of the central strip 3C of the film 3.

The band 7 covers, on the one hand, partly the face 3F1 of the film 3 intended to be directed towards the surface 11 of the container 10 provided with the opening, as well as the first end 3C1 of the central part of the strip 3C, and, on the other hand, partly the first face 1F1 of the foam layer 1, as well as at least partly the first part 5B of the foam layer 1 provided with a low friction layer.

Similarly, a sticking strip or band 8 covers, on the one hand, partly the face 3F1 of the film 3 intended to be directed towards the surface 11 of the container 10 provided with the opening, as well as the second end 3C2 of the central part of the strip 3C, and, on the other hand, partly the first face 1F1 of the foam layer 1, as well as, in specific embodiment, at least partly the second part 5A of the foam layer 1 provided with a low friction layer.

The adhesive force of the adhesive strips 7, 8 is preferably just sufficient to be glued on the film and on the layer made of silicone.

When the means of the FIG. 1 to 4 is provided with a glue layer on the part of the face 1F1 of the foam layer not covered by the film 3, the means is advantageously provided with a peelable protective film. Said film is withdrawn before sticking or attaching the foam layer on the surface 11 of the toner container or toner cartridge 10.

The foam layer is thus advantageously provided with adhesive means along its longitudinal edges 51,52. These adhesive means are used to glue the edge parts 3A,3B of the film on the foam layer and also to glue the foam layer 5 on a surface 11 of the toner cartridge 10.

The pulling means 4 is partially located in the opening or central passage 2 of the foam layer 1.

A part 4A of the pulling means is located outside the film 3.

The central strip 3C has its end 3C1, which is located partially between two cuts 6 (means for reducing the initial pull force).

The adhesive force of the adhesive strips 7, 8 is preferably just sufficient to be glued on the film and on the layer made of silicone.

Figures 5, 6:
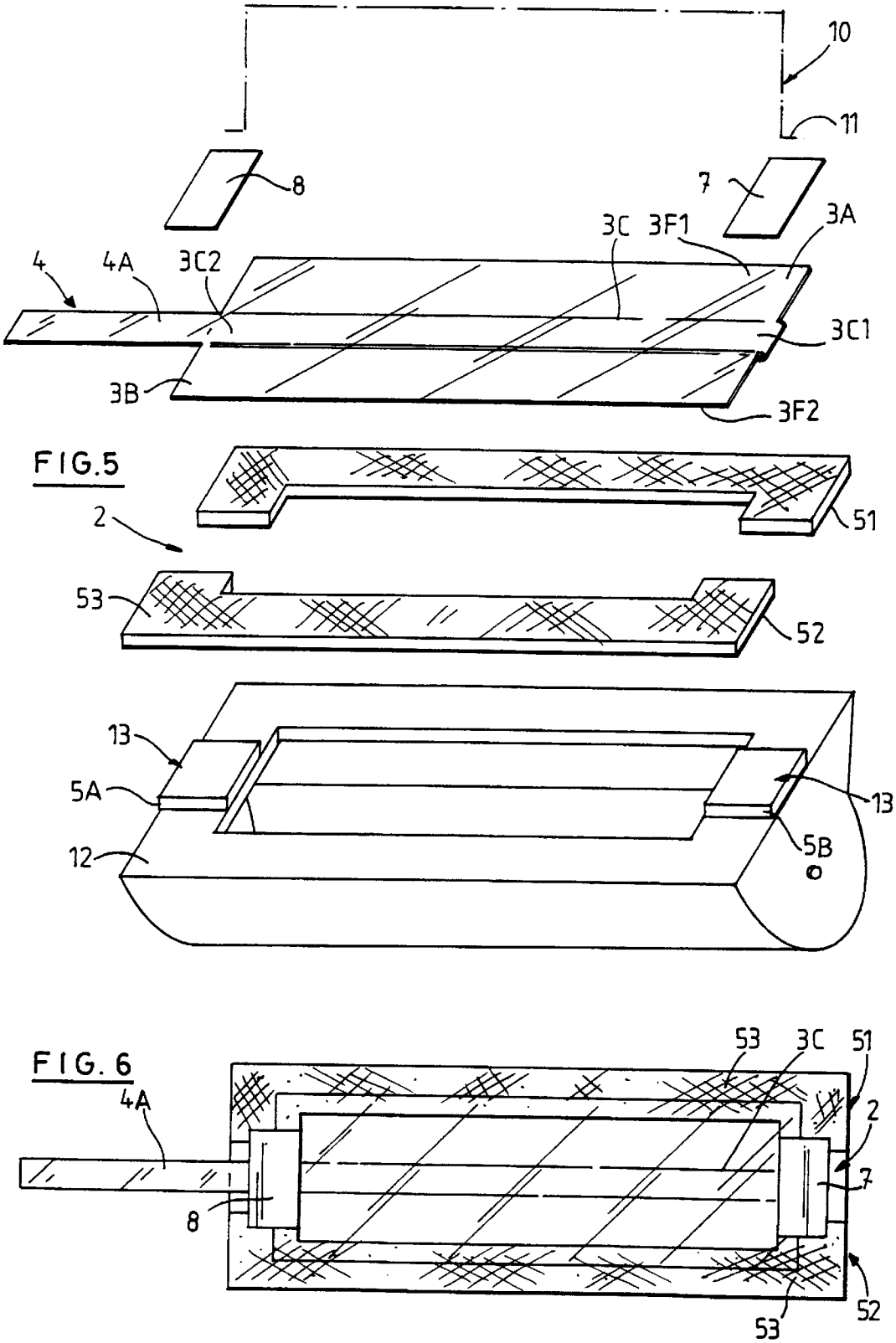
FIG. 5 is a perspective (exploded) view of the parts of another embodiment of a means according to the invention.
FIG. 6 is an upper view of the means of FIG. 5.

FIG. 5 and FIG. 6 relate to a second embodiment which is similar to the embodiment illustrated in FIG. 1 to 4. In this embodiment, the foam layer consists made of two longitudinal foam strips 51, 52, between which a passage 2 is defined. The support 12 of the inkroller is provided with two foam parts 13, the shape of which is adapted to be inserted in the passage 2 and to push the ends 3C1, 3C2 of the central strip 3C on the surface 11 of the toner cartridge.

Figure 7:
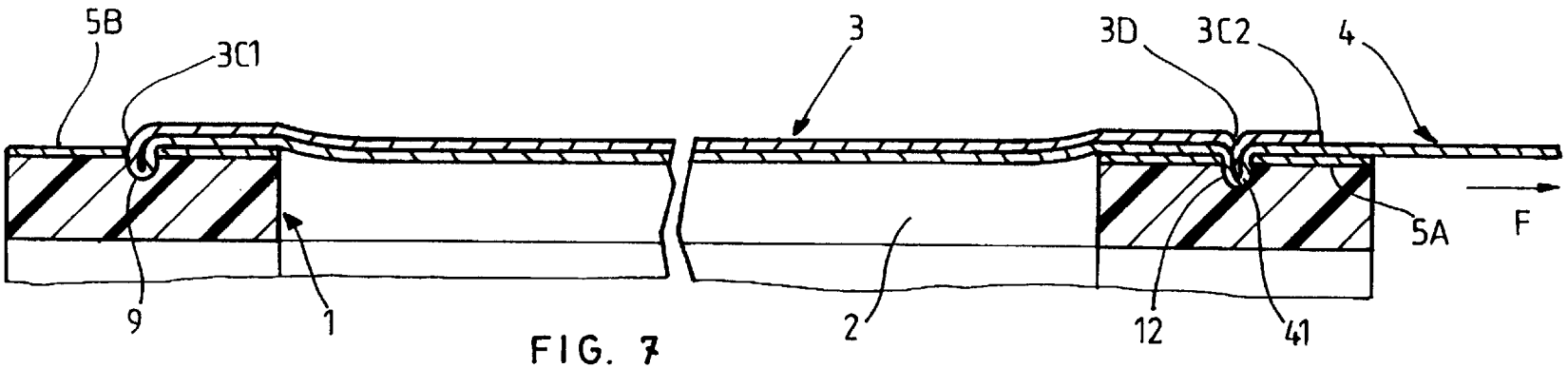
FIG. 7 is a cross section view of a third embodiment.

FIG. 7 is a detailed view of the ends 3C1 and of a central strip 3C of the third embodiment. In this embodiment, the end 3C1 is bent and inserted in a groove 9 from the foam layer. A part 3D of the central strip 3C, which lays in the neighbourhood of the end 3C2, and a part 41 from the pulling means 4 are bent and inserted together in a groove 12. By exerting a pull force F on the pulling means 4, the parts 41 and 3D are first pulled out of the groove 12. Then the end 3C1 is pulled out of the groove 9, and the pulling means and the central strip 3C slip or glide on the layers 5A, 5B made of silicone.

The means according to the invention is intended to form a seal between the ink container 11 and the support 12 of the ink rolls.

As the foam layer is not completely covered by the film all around, this elastic foam layer forms a good seal between the sides of the container and the sides of the support.

What I claim is:

1. A means for sealing a toner container for laser printer, copy machine and laser printer, said container having a surface provided with an opening for the passage of toner, said means comprising:

a) a film comprising two lateral strips and a central strip extending between a first end and a second end, said central strip being intended to be torn off from said first end to said second end so as to define an opening between the said lateral strips, said film having two opposite faces, one of which being intended to be directed towards the surface of the container provided with the opening;

b) a pulling means bound to said first end of the central strip of the film; and c) a foam layer with a central passage, said layer having a first face intended to be directed towards the surface of the container provided with the opening, and a second face opposite to said first face, said first face having a first part covered by the film and a second part not covered by the film, in which the lateral strips of the film are glued on said first part of the first face of the foam layer, while the central strip intended to be torn off from the film is not glued on said foam layer, in which the pulling means extends along the face of the film opposite to the face intended to be directed towards the surface of the container provided with the opening, said pulling means being not glued on the foam layer, and in which, in the neighbourhood of the first end of the central strip, a means binds the foam layer with the lateral strips and with the central strip of the film so as to prevent toner leakage between the film and the foam at said first end of the central strip.

2. The means of claim 1, in which the second part of the foam layer is provided with a glue layer for attaching said second part on the said surface with the opening of the container.

3. The means of claim 1, in which a means binds the foam layer with the lateral strips and with the first end of the central strip of the film so as to prevent toner leakage between the film and the foam at said first end of the central strip.

4. The means of claim 1, in which a means binds the foam layer with the face of the film intended to be directed towards the surface of the container provided with the opening so as to prevent toner leakage between the film and the foam at said first end of the central strip.

5. The means of claim 1, in which the means for avoiding leaks is a small adhesive band which covers, on one hand, partially the foam layer, and on the other hand, partly the face of the film intended to be directed towards the surface of the container provided with the opening, as well as the first end of the central strip.

6. The means of claim 1, in which the first face of the foam layer has a part contacting the pulling means, said part being provided with a layer with a low friction coefficient.

7. The means of claim 1, in which the first face of the foam layer has a first part contacting the pulling means in the neighbourhood of the first end of the central strip of the film and a second part contacting the pulling means in the neighbourhood of the second end of the central strip of the film, said first and second parts of the foam layer being provided with a layer with a low friction coefficient.

8. The means of claim 1, in which the first face of the foam layer has a first part contacting the pulling means in the neighbourhood of the first end of the central strip of the film, said first part of the foam layer being provided with a layer with a low friction coefficient, and in which, before moving the pulling means and tearing off the central part of the film, the means to avoid ink leaks is a band covering, on the one hand, the face of the film intended to be directed towards the surface of the container provided with the opening, as well as the first end of the central part of the strip, and, on the other hand, the first face of the foam layer, as well as the first part of the foam layer provided with a low friction layer.

9. The means of claim 1, in which the first face of the foam layer has a first part contacting the pulling means in the neighbourhood of the first end of the central strip of the film and a second part contacting the pulling means in the neighbourhood of the second end of the central strip of the film, said first and second parts of the foam layer being provided with a layer with a low friction coefficient, and in which, before moving the pulling means and tearing off the central part of the film, a first band covers, on the one hand, the face of the film intended to be directed towards the surface of the container provided with the opening, as well as the first end of the central part of the strip, and, on the other hand, the first face of the foam layer, as well as the first part of the foam layer provided with a low friction layer, while a second band covers, on the one hand, the face of the film intended to be directed towards the surface of the container provided with the opening, as well as the second end of the central part of the strip, and, on the other hand, the first face of the foam layer, as well as possibly the second part of the foam layer provided with a low friction layer.

10. The means of claim 1, in which the means for avoiding leaks between the central strip and the foam layer is a groove in the foam, in which the first end of the central strip or a part of the central strip adjacent to its first end is inserted.

11. The means of claim 1, in which the foam layer has a groove, in which a part of the pulling means adjacent to the second end of the central strip, as well as a part of the film adjacent to said second end of the central strip are inserted.

12. The means of claim 1, in which the foam layer consists of two distinct foam strips between which the central passage is defined.

13. Toner container for laser printer, copy machine and laser printer provided with a sealing means, said container having a surface provided with an opening for the passage of toner, said sealing means comprising:

a) a film comprising two lateral strips and a central strip extending between a first end and a second end, said central strip being intended to be torn off from said first end to said second end so as to define an opening between said lateral strips, said film having two opposite faces, one of which being intended to be directed towards the surface of the container provided with the opening;

b) a pulling means bound to said first end of the central strip of the film; and c) a foam layer with a central passage, said layer having a first face intended to be directed towards the surface of the container provided with the opening, and a second face opposite to said first face, said first face having a first part covered by the film and a second part not covered by the film, in which the lateral strips of the film are glued on the said first part of the first face of the foam layer, while the central strip intended to be tom off from the film is not glued on said foam layer, in which the pulling means extends along the face of the film opposite to the face intended to be directed towards the surface of the container provided with the opening, said pulling means being not glued on the foam layer, and in which, in the neighbourhood of the first end of the central strip, a means binds the foam layer with the lateral strips and with the central strip of the film so as to prevent toner leakage between the film and the foam at said first end of the central strip.

14. The container of claim 13, in which a means binds the foam layer with the lateral strips and with the first end of the central strip of the film so as to prevent toner leakage between the film and the foam at said first end of the central strip.

15. The container of claim 13, in which a means binds the foam layer with the face of the film intended to be directed towards the surface of the container provided with the opening so as to prevent toner leakage between the film and the foam at said first end of the central strip.

16. The container of claim 13, in which the means for avoiding leaks is a small adhesive band which covers, on one hand, partially the foam layer, and on the other hand, partly the face of the film intended to be directed towards the surface of the container provided with the opening, as well as the first end of the central strip.

17. The container of claim 13, in which the first face of the foam layer has a part contacting the pulling means, said part being provided with a layer with a low friction coefficient.

18. The container of claim 13, in which the first face of the foam layer has a first part contacting the pulling means in the neighbourhood of the first end of the central strip of the film and a second part contacting the pulling means in the neighbourhood of the second end of the central strip of the film, said first and second parts of the foam layer being provided with a layer with a low friction coefficient.

19. The container of claim 13, in which the first face of the foam layer has a first part contacting the pulling means in the neighbourhood of the first end of the central strip of the film, said first part of the foam layer being provided with a layer with a low friction coefficient, and in which, before moving the pulling means and tearing off the central part of the film, the means to avoid ink leaks is a band covering, on the one hand, the face of the film intended to be directed towards the surface of the container provided with the opening, as well as the first end of the central part of the strip, and, on the other hand, the first face of the foam layer, as well as the first part of the foam layer provided with a low friction layer.

20. The container of claim 13, in which the first face of the foam layer has a first part contacting the pulling means in the neighbourhood of the first end of the central strip of the film and a second part contacting the pulling means in the neighbourhood of the second end of the central strip of the film, said first and second parts of the foam layer being provided with a layer with a low friction coefficient, and in which, before moving the pulling means and tearing off the central part of the film, a first band covers, on the one hand, the face of the film intended to be directed towards the surface of the container provided with the opening, as well as the first end of the central part of the strip, and, on the other hand, the first face of the foam layer, as well as the first part of the foam layer provided with a low friction layer, while a second band covers, on the one hand, the face of the film intended to be directed towards the surface of the container provided with the opening, as well as the second end of the central part of the strip, and, on the other hand, the first face of the foam layer, as well as possibly the second part of the foam layer provided with a low friction layer.

21. The container of claim 13, in which the means for avoiding leaks between the central strip and the foam layer is a groove in the foam, in which the first end of the central strip or a part of the central strip adjacent to its first end is inserted.

22. The container of claim 13, in which the foam layer has a groove, in which a part of the pulling means adjacent to the second end of the central strip, as well as a part of the film adjacent to said second end of the central strip are inserted.

23. The container of claim 13, in which the foam layer consists of two distinct foam strips between which the central passage is defined.

* * * * *